US005762378A

United States Patent [19]

Phillips

[11] Patent Number: 5,762,378

[45] Date of Patent: Jun. 9, 1998

[54] TAMPER RESISTANT VALIDATION MARKS

[75] Inventor: George K. Phillips, Paso Robles, Calif.

[73] Assignee: Verify First Technologies, Inc., Paso Robles, Calif.

[21] Appl. No.: 602,244

[22] Filed: Feb. 16, 1996

[51] Int. Cl.[6] ..... B42D 15/00

[52] U.S. Cl. ..... 283/72; 285/100; 285/58; 428/916

[58] Field of Search ..... 283/72, 81, 86, 283/93, 94, 91, 105, 57–59, 901–904, 61, 62, 100; 281/2, 5; 40/446, 453, 299; 478/43; 428/916

[56] References Cited

U.S. PATENT DOCUMENTS

| | | | |
|---|---|---|---|
| 1,303,434 | 5/1919 | Whitaker | 283/105 |
| 1,621,457 | 3/1927 | Bullock | 283/105 |
| 1,727,912 | 9/1929 | Snyder | 283/72 |
| 1,998,237 | 4/1935 | Himmell . | |
| 2,065,605 | 12/1936 | Moore | 283/72 |
| 2,285,806 | 6/1942 | Close | 283/72 |
| 3,282,720 | 11/1966 | Oleksiw . | |
| 3,802,724 | 4/1974 | Gosnell | 283/9 |
| 4,025,673 | 5/1977 | Reinnagel | 428/29 |
| 4,033,059 | 7/1977 | Hutton et al. | 283/91 |
| 4,066,280 | 1/1978 | La Capria | 283/8 |
| 4,082,426 | 4/1978 | Brown | 350/105 |
| 4,151,666 | 5/1979 | Rapheal et al. | 40/2.2 |
| 4,163,570 | 8/1979 | Greenaway | 283/8 |
| 4,168,088 | 9/1979 | Somlyody | 283/8 |
| 4,175,774 | 11/1979 | Tonges et al. | 283/6 |
| 4,175,776 | 11/1979 | Ranauro | 283/8 |
| 4,184,700 | 1/1980 | Greenaway | 283/6 |
| 4,227,719 | 10/1980 | McElligott et al. | 283/8 |
| 4,265,469 | 5/1981 | Mowry et al. | 283/8 |

(List continued on next page.)

OTHER PUBLICATIONS

McGarry, Dennis, "Document Security", *Technical Update–National Business Forms Association*, Dec. 1, 1990, pp. 3–8.

National Business Forms Association, "Watermarked and Non–Impact Papers", *Technical Report*, Aug. 17, 1987, vol. 1, No. 8, T.U. #32 (LLB) , pp. 1–3.

The Standard Registry Company, "Making It Easy for People to Be Honest —Three Steps to Document Security", *Standard Register*, Form No. 5463 4.89–1, 1990, pp. 1–6.

McLoone, Sharon, "Inks That Are Mightier Than the Counterfeiter", *Form*, May 1995, pp. 88, 90, 93.

Steven S. Scaman et al., "Security Indicator Inks Gain Market Prominence", *Flexo*, Dec. 1994, pp. 14, 16–17.

*Primary Examiner*—Willmon Fridie, Jr.
*Attorney, Agent, or Firm*—Lyon & Lyon LLP

[57] ABSTRACT

The present invention includes a pattern of fine slits formed in the material of document where sensitive information is intended to be printed or imprinted, wherein the slit pattern modifies the tensile strength of the substrate. In addition, the slit pattern modifies the toner or ink permeability of a substrate to facilitate the penetration of the toner or ink printed or imprinted on the surface of document into the substrate. Further, the design of the slit pattern can be coordinated with a latent image pattern to comprise optical properties such that the physical response of a typical duplicating or photocopy device to the validation mark will allow a copy to be easily discerned from an original.

11 Claims, 6 Drawing Sheets

U.S. PATENT DOCUMENTS

| | | | |
|---|---|---|---|
| 4,303,307 | 12/1981 | Tureck | 350/276 |
| 4,307,899 | 12/1981 | Hoppe | 283/7 |
| 4,341,404 | 7/1982 | Mowry et al. | 283/8 |
| 4,351,547 | 9/1982 | Brooks, II | 283/8 |
| 4,428,997 | 1/1984 | Shulman | 283/94 |
| 4,455,039 | 6/1984 | Weitzen et al. | 283/83 |
| 4,522,429 | 6/1985 | Gardner et al. | 283/91 |
| 4,534,398 | 8/1985 | Crane | 162/103 |
| 4,573,409 | 3/1986 | Clar et al. | 283/901 |
| 4,579,370 | 4/1986 | Corwin et al. | 283/72 |
| 4,629,630 | 12/1986 | Devrient | 427/7 |
| 4,795,894 | 1/1989 | Sugimoto et al. | 235/468 |
| 4,867,481 | 9/1989 | Gundjian | 283/91 |
| 4,869,532 | 9/1989 | Abe et al. | 283/88 |
| 4,892,385 | 1/1990 | Webster, Jr. et al. | 350/162.23 |
| 4,988,126 | 1/1991 | Heckenkamp et al. | 283/92 |
| 5,029,901 | 7/1991 | Dotson et al. | 462/8 |
| 5,044,707 | 9/1991 | Mallik | 359/2 |
| 5,093,184 | 3/1992 | Edwards | 428/192 |
| 5,137,304 | 8/1992 | Silverschotz | 283/100 |
| 5,149,140 | 9/1992 | Mowry, Jr. et al. | 283/93 |
| 5,190,318 | 3/1993 | Mantegazza | 283/82 |
| 5,197,765 | 3/1993 | Mowry, Jr. et al. | 283/93 |
| 5,209,698 | 5/1993 | Dolan | 283/72 |
| 5,271,645 | 12/1993 | Wicker | 283/92 |
| 5,290,068 | 3/1994 | Gundjian | 283/91 |
| 5,344,192 | 9/1994 | Phillips | 283/91 |
| 5,454,598 | 10/1995 | Wicker | 283/67 |

TAMPER RESISTANT VALIDATION MARKS

BACKGROUND OF THE INVENTION

1. Field of the Invention

The field of the invention pertains to the prevention and detection of the unauthorized alteration or duplicating of valuable documents. In particular, the field of the present invention pertains to validation marks on documents which are resistant to unauthorized tampering or counterfeiting.

2. The Related Art

Presently known approaches for recognizing altered, duplicate or counterfeit copies of original documents have generally sought to prevent alteration, duplication or counterfeiting of documents by physical alteration, electronic scanning or xerographic photocopying by printing information on the document in specially designed inks or other printing materials so that the printed information can be viewed on the original, but due to the unique color, texture, or reflective properties of the printed information on the altered or counterfeited copy, will be readily discernable from the original.

For example, U.S. Pat. No. 4,066,280 to LaCapria describes a document upon which is printed a specularly reflective coloring material such as powdered aluminum, which is not accurately reproduced by color copiers. The duplicate image will appear in different colors than on the original.

Similarly, U.S. Pat. No. 4,988,126 to Heckenkamp et al. describes an original document having surface relief in the form of embossed characters. A luminescent substance is formed into raised or depressed areas of the surface relief. The reflective properties of the surface relief render the original readily discernable from a photocopy which lacks the surface relief.

U.S. Pat. No. 4,082,426 describes retroreflective sheet materials formed of a monolayer of microsphere-lenses overlaying a specularly reflective layer coated over a polymeric material. A transparent image layer of varying thickness permits light rays to be transmitted to and reflected by the specularly reflective layer behind the image layer. The varying thickness of the image layer and the spacing between the specularly reflective layer and the microsphere-lenses changes the reflective characteristics of the sheeting, so that markings on the sheet are visible only from certain angles under retroreflective viewing conditions.

U.S. Pat. No. 4,892,385 to Webster, Jr. et al. describes an authenticating device which can be bonded to the surface of a document to identify an original document.

Another approach has been to provide specially manufactured copy-resistant paper upon which information of any kind can be printed using conventional processes and inks. For example, U.S. Pat. No. 4,867,481 to Gundjian describes copy-resistant paper having a two-color grid-like pattern printed over its surface, with each color having the same spectral profile but different spectral response. U.S. Pat. No. 4,303,307 to Tureck et al. describes a paper substrate coated with specially sized and spaced beads which break up incident light emitted by a photocopier. U.S. Pat. No. 5,093,184 to Edwards describes security paper having elongated metallic elements embedded in the paper.

Yet another approach has been to provide specially designed inks or other printing materials having different or unique color or reflective properties. For example, U.S. Pat. No. 5,271,645 to Wicker describes a color-copier resistant pigment consisting of print stuff mixtures obtained by mixing commercially available pigments with fluorescence compound.

U.S. Pat. No. 4,869,532 to Abe et al. describes a print produced by printing or coating an infrared reflective coloring agent and another printing ink containing an infrared absorptive coloring agent in combination on a base material, to produce visually-recognizable information along with other information recognizable with the aid of infrared lighting.

U.S. Pat. No. 4,025,673 and U.S. Pat. No. 3,887,742 to Reinnagel describe prevention of photocopying by selection of different color or color filter combinations for the text and background.

U.S. Pat. No. 4,175,776 to Ranauro describes a document in which the text and background are characterized by different optical reflectivities for incident visible light and which are substantially non-absorbing with respect to incident light having wavelengths within the response spectrum of color xerographic copying machines. When the document is photocopied, the incident light of the photocopier produces a uniform reflected pattern over the indicia which causes the indicia to "drop out" of the copy.

U.S. Pat. No. 4,522,429 to Gardner et al. discloses a document upon which text is printed upon colored paper having a reflection spectral response of less than about ten percent for light of below 600 millimicron wavelength, so that the color is sufficiently contrasting with the text to be visible when viewed under white light, but cannot be successfully photocopied.

SUMMARY OF THE INVENTION

The tamper-resistant validation marks of the present invention comprises a pattern of fine slits formed in the material of document where information is intended to be printed or imprinted. The size and placement of slit pattern modifies the tensile strength of the substrate such that unauthorized tampering of the printed or imprinted information on document may result in the partial disfiguring or "tearing" of the substrate. In addition, the slit pattern modifies the ink permeability of substrate such as to facilitate the penetration of the ink printed or imprinted on the surface of document into substrate. Further, the design of the slit pattern is coordinated with a latent image pattern to comprise optical properties such that the physical response of a typical duplicating or photocopy device to the validation mark will allow a copy to be easily discerned from an original. Additionally, the latent image pattern is not reproducible by conventional copying devices because the slit pattern comprise physical details of document which are not reproducible by conventional photocopy or duplicating devices.

BRIEF DESCRIPTION OF THE DRAWING FIGURES

DETAILED DESCRIPTION OF THE PREFERRED EMBODIMENT

Figure 1:
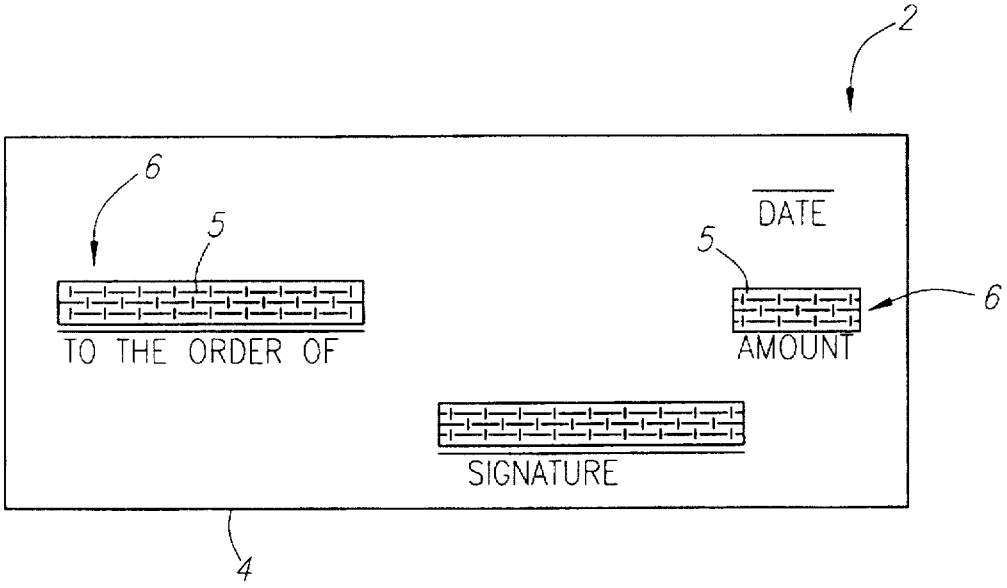
FIG. 1 depicts a document comprising a tamper resistant validation mark according to an embodiment of the present invention.

FIG. 1 depicts a document 2 comprising a substrate 4 and tamper-resistant validation marks 6 according to an embodiment of the present invention. The substrate 4 is preferably of paper stock; however, any material suitable to the application may be used without departing from the scope of the present invention. It is anticipated that the present invention will be particularly suitable for checks and other documents of value, although the present invention is not limited to these applications and can be used in any application in which it is desirable to be able to prevent or detect the tampering, alteration or reproduction of an original document.

Figure 2:
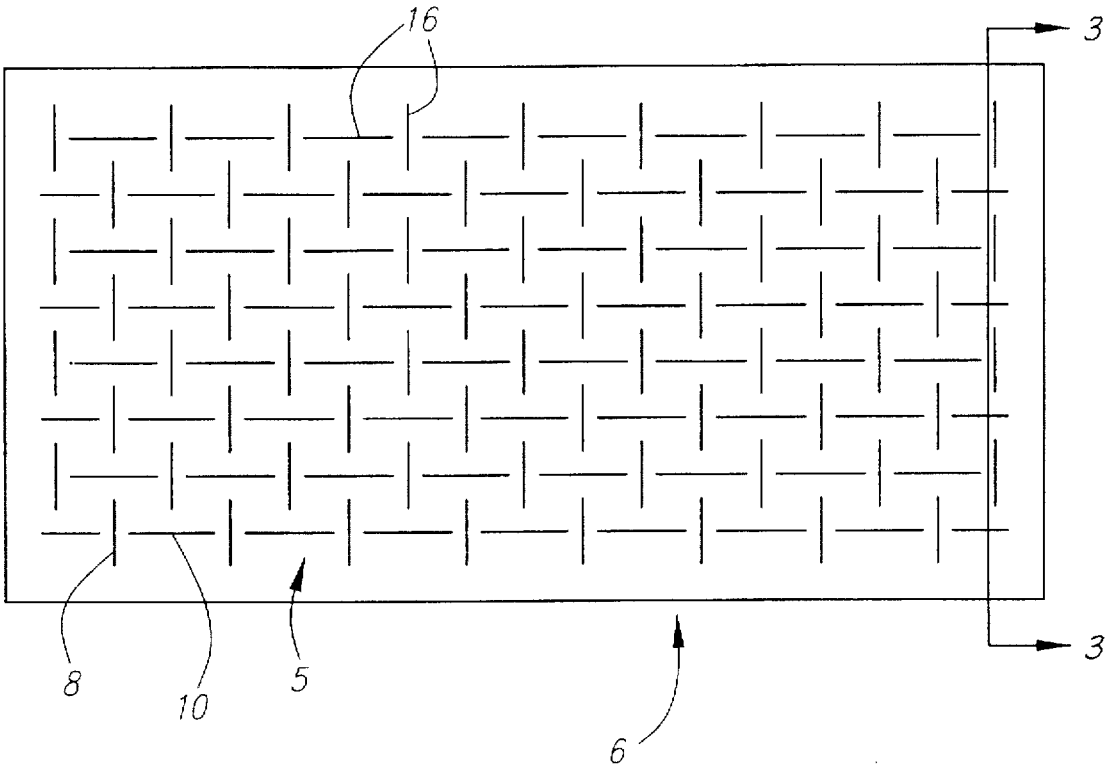
FIG. 2 depicts a preferred slit pattern according to an embodiment of the present invention.
Figure 2A:
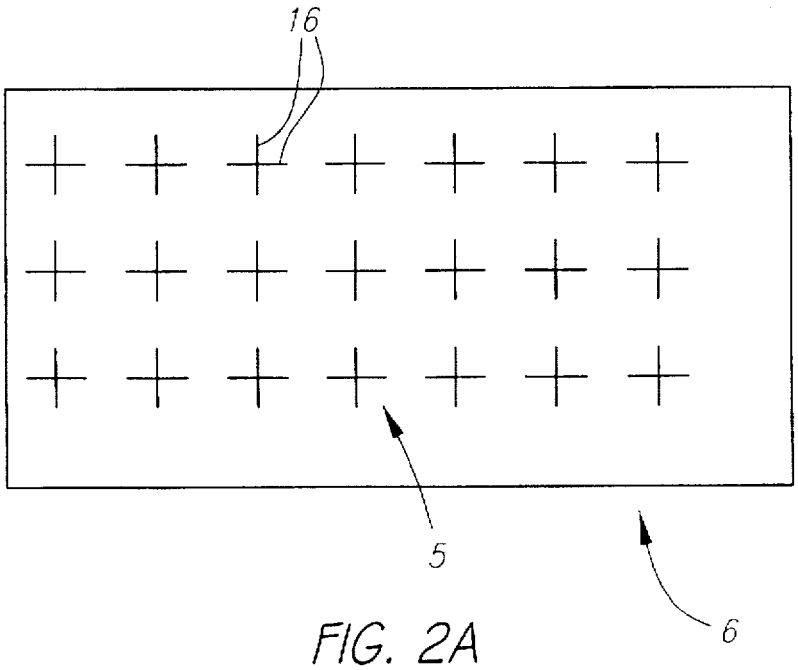

The tamper-resistant validation marks 6 of the present invention comprises a pattern of fine slits 5 formed in the material of substrate 4 in areas of document 2 where sensitive information is intended to be printed or imprinted. FIG. 2 depicts the slit pattern 5 of an embodiment of the tamper-resistant validation markings 6. Each slit pattern 5 preferably comprises a plurality of fine openings ("slits") 16 which pierce the substrate 4 in substantially straight lengths. The slits 16 are preferably arranged in a pattern of alternating slits running both horizontally 10 and vertically 8 as shown in FIG. 2, and in one preferred embodiment, the horizonal slits 10 and vertical slits 8 do not intersect (as used herein the terms "horizontal" and "vertical" are employed for purposes of illustration only, and are not intended in any way to be limiting as to the orientation of the slits). Other patterns of slits are expressly contemplated within the scope of the present invention, and the actual placement of the slits would depend on the particular application to which this invention is to be used. As just one example, it is contemplated that intersecting rows and columns of vertical or parallel slits may be employed in the present invention, as depicted in FIG. 2A. Other applications may require the slit pattern 5 to employ slits 16 which are substantially curved or shaped.

Figure 3:
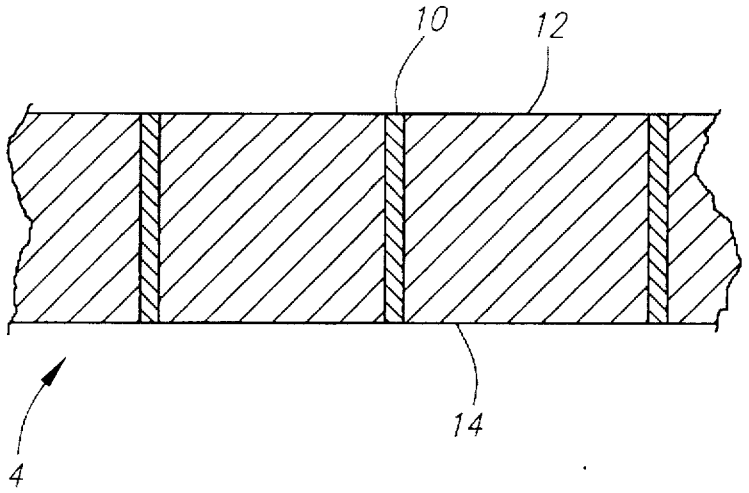
FIG. 3 is a partial cross-sectional view of the slit pattern and tamper resistant validation mark pattern of FIG. 2 along line A—A.
Figure 4:
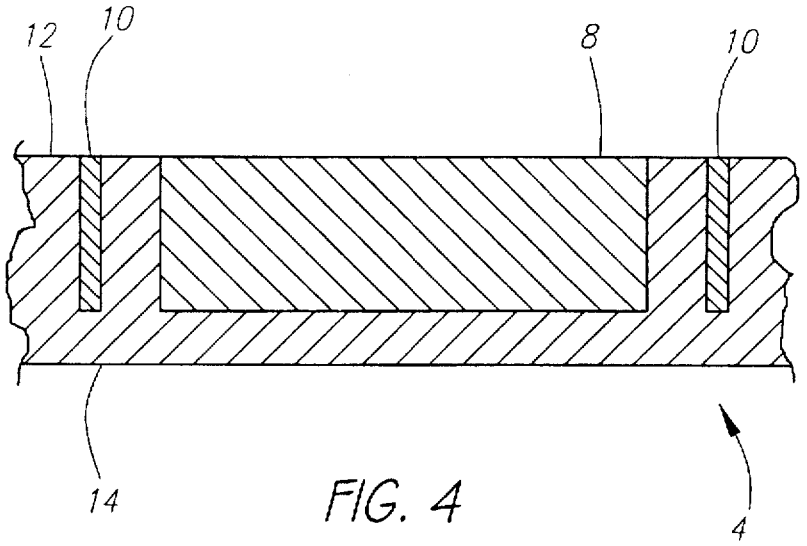
FIG. 4 is a partial cross-sectional view of an alternate embodiment of a validation mark according to the present invention.

FIG. 3 is a cross-sectional view of the tamper-resistant validation mark 6 of FIG. 2 from line A—A, showing the structure of horizontal slits 10. In this embodiment, horizontal slits 10 preferably penetrate the entire structure of substrate 4, extending from the top surface 12 to the bottom surface 14. The vertical slits 8 (not shown in FIG. 3) are preferably structured similar to the horizontal slits 10, also defined by a straight length comprising an opening in the top surface 12 to an opening in the bottom surface 14 of substrate 4. Alternatively, depending upon the particular application, the slit pattern 5 may employ slits which extend only partially through the substrate 4 (FIG. 4).

In one respect, the present invention prevents unauthorized tampering or alteration of a document by modifying the tensile strength of the substrate 4 as a result of the placement and configuration of slit pattern 5. The present invention is particularly useful when employed within areas of documents 2 where writing, printing or imprinting of toner or ink is required, for example, at the "pay to the order of" section or "dollar amount" section of a typical check. Attempts to alter the toner or ink pattern which has been applied to tamper-resistant verification marks 6 by mechanical means will cause pressure to be applied to the slit pattern 5 in a lateral direction relative to the substrate 4, e.g. by frictional pressure applied via a rubbing, scraping, or erasing action. Because the tensile strength of the material will be reduced between the slits 16 of the slit pattern 5, any attempt to apply lateral force to the tamper-resistant verification markings 6 will result in the whole or partial damaging or "tearing" of the substrate 4 between adjacent slits. This tearing renders the document instantly identifiable as possibly being the subject of an unauthorized alteration.

The threshold tensile strength of substrate 4 is preferably set high enough such that writing, printing or imprinting upon the slit pattern 5 will be possible, but any lateral pressure sufficient to alter such writing, printing or imprinting will cause the disfigurement or tearing of the substrate 4. The length or width of the slits as depicted in the figures are for the purposes of illustration only; the actual dimensions or shape of the slits in slit pattern 5 can be modified to bring about desired tensile strength properties upon the document 2. The quality and choice of material used as the substrate 4 also influence the optimal width and length of the preferred vertical slits 8 and horizontal slits 10.

Figure 5:
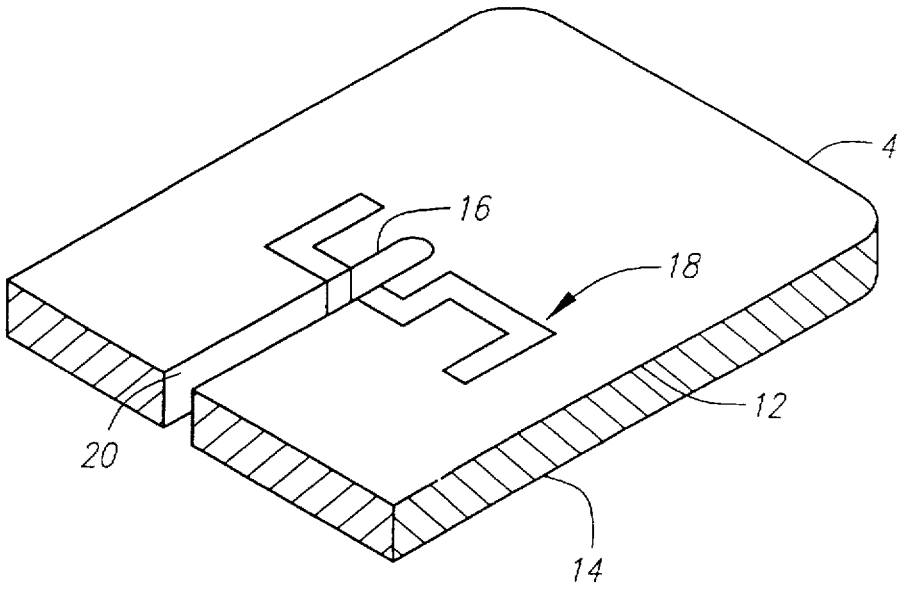
FIG. 5 is a partial magnified view of a single slit according to an embodiment of the present invention.
Figure 6:
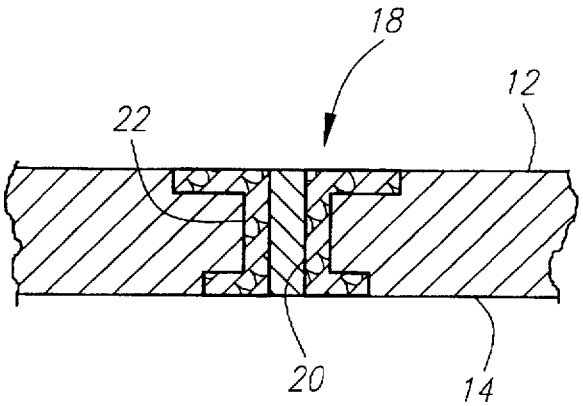
FIG. 6 depicts a cross-sectional view of an example of an ink bleed pattern on a single slit according to an embodiment the present invention.

The slit pattern 5 also provides for increased permeability and absorption of toner or ink 18 which is applied onto document 2. FIG. 5 illustrates a magnified section of substrate 4 containing part of a single slit 16. Information is preferably applied to the surface 12 of substrate 4 such that the application of toner or ink 18 traverses one or more of the slits 16. Referring to FIG. 6, the opening in the surface 12 of substrate 4 provided by slit 16 allows toner or ink 18 to bleed through and permeate into the adjacent inner walls 20 and subsurface areas 22 of substrate 4. In some applications, toner or ink 18 may also sufficiently bleed through the slit 16 to become absorbed within the lower surface 14 of substrate 4.

This adherence of toner or ink to these inner walls 20, subsurface areas 22, and lower surface 14 make it difficult to tamper with or counterfeit the information applied to document 2. Attempts to alter or remove absorbed toner or ink from the inner walls 20 or lower surface 14 by chemical, mechanical or frictional means will likely damage or tear the document 2, as described above. Further, the deep penetration of ink 18 into the subsurface areas 22 will render it unlikely that ink 18 can be removed or modified from the subsurface areas 22 without leaving obvious evidence or indications of any attempted modification to the document 2.

Counterfeit or duplicate documents produced by typical duplicating or photocopier devices will be easily detected, since conventional photocopiers only duplicate surface images on a document, thus the toner or ink absorption pattern from within internal walls 20 of the slits 16 will not be accurately duplicated in a photocopy or counterfeit. In addition, counterfeits or duplicates are easily detected since conventional duplicating or photocopier devices cannot accurately duplicate three-dimensional physical features on a document. Attempts to perform the unauthorized duplicating or counterfeiting of documents employing the present invention will be readily identifiable because of the lack of physical slits which run through the duplicate.

Figure 7:
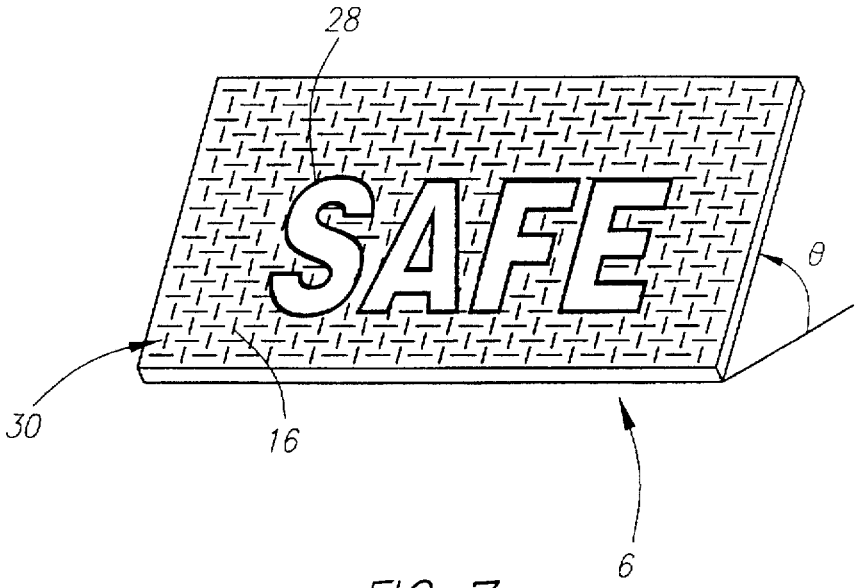
FIG. 7 depicts an embodiment of the present invention viewed at relative angle θ.

Referring to FIG. 7, an alternate embodiment of the present invention comprises the coordination of a surface relief pattern formed by a background structure 30 of slits 16 with a surface relief pattern formed by a latent image structure 28. As disclosed in co-pending application Ser. No. 08/568,587 (which is hereby incorporated by reference in its entirety), contrasting optical properties between the surface relief patterns of a background structure 30 and an image structure 28 allows the formation of a "latent" image which is hidden when viewed at an incorrect viewing angle, but which forms a "visible" image when viewed at the correct viewing angle(s) θ. In the present invention, the background structure 30 is coordinated with the image structure 28 such that the latent image is not visible when viewed at an angle perpendicular relative to document 2, thus preventing the accurate duplicating or counterfeiting of the document by conventional electronic scanning or photocopy devices, since such devices typically "view" documents at a perpendicular angle relative to the document.

Figure 8:
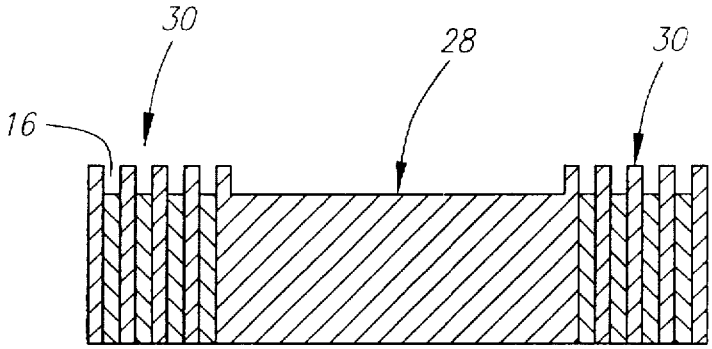
FIG. 8 is a cross-sectional view of an embodiment of the present invention showing relative surface relief patterns.

Referring to FIG. 8, background relief structure 30 is preferably formed by a pattern of slits 16 formed in substrate 4. Image relief structure is preferably formed in solid areas of substrate 4 containing no slits 16. As depicted in FIG. 8, the surface relief pattern formed by image structure 28 is distinct and in contrast to the surface relief pattern formed by background structure 30. Because of the differing surface relief between the two structures, incident light rays which reflect from the background structure 30 would be different in intensity and character from light rays which reflect from the image structure 28. The reflected light rays may be diffractionally and/or diffusionally modified by the surface relief pattern of the two structures. As described in more detail in co-pending application Ser. No. 08/568,587, it is the contrast in reflected light between the two structures which allows the formation of a latent image pattern and which renders the latent image visible when document 2 is viewed at relative angle(s) θ. The dimensions of slit pattern 5, e.g. spacing, height, or width, can be altered to change the diffractional and/or diffusional effects of the surface relief on incident light rays 2. The height, width, and spacing of the relief structures in shown in FIG. 8 are for purposes of illustration only, and are not intended in any way to be limiting.

Figure 9:
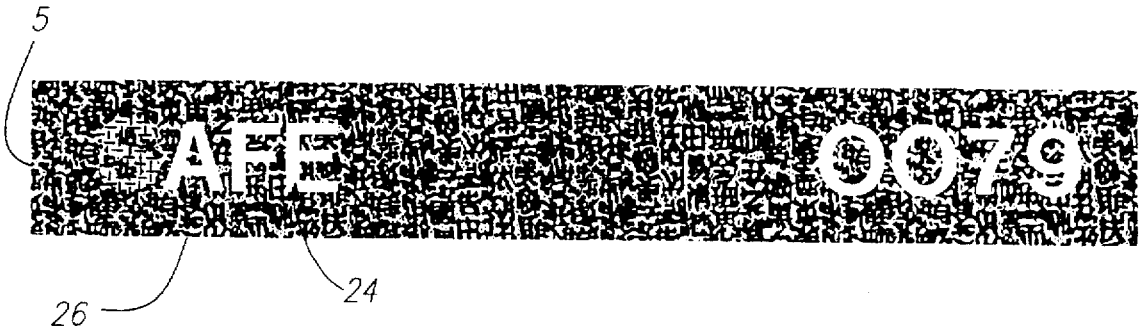
FIG. 9 depicts an embodiment of the present invention showing a preferred camouflaged background pattern.

Referring to FIG. 9, another embodiment of the present invention may comprise latent image(s) 24 which are camouflaged within a patterned background 26 which includes complex slit pattern 5. The camouflaged background patterns 26 preferably have contrasting optical/reflective properties which generally render an overprinted latent image 24 difficult to view at a relatively oblique or perpendicular angle, but renders latent image 24 visible when document 2 is held at the proper relative viewing angle θ. Preferably, the patterned background 24 comprises a complex asymmetrical pattern of alternating black-and-white areas, however, the patterns used in a particular application need not be limited to black-and-white areas; any combination of colors can be used. Other contrasting background patterns 24 useful in the present invention are disclosed in more detail in co-pending U.S. application Ser. No. 08/450,975, which is hereby incorporated by reference in its entirety.

The design of slit patterns 5 is coordinated within the markings of background pattern 26 such that the optical/reflective properties of the combined pattern renders latent image 24 "invisible" or obscured at relatively perpendicular or oblique angles, thus preventing the accurate duplication or photocopying of the document 2 by conventional electronic scanning or photocopy devices. As shown in FIG. 9, the individual slits 16 of slit pattern 5 are preferably placed to enhance the visible aspects and details of the elements forming the background pattern 26 so as to make the graphics or characters printed or produced thereon blend and be somewhat difficult to ascertain. The slit pattern 5 may be configured such that the slits 16 are outlined around or formed in the elements forming background pattern 26, and the concentration of the slits 16 may thus enhance the aspects of these elements. The image 24 which is overprinted onto background pattern 26 is preferably comprised of either metallic, magnetic or thermochromic inks.

Figure 10:
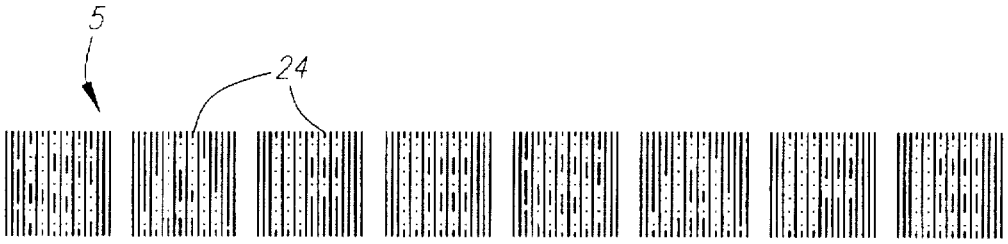
FIGS. 10–14 show alternate embodiments of slit patterns employed in the present invention.

FIGS. 10–14 depict several alternatively preferred embodiment of the present invention comprising a slit pattern 5 coordinated with latent image 24. FIG. 10 depicts an slit pattern 5 having an intersecting formation of densely packed vertical and horizontal slits. A latent image 24, forming the validation word "SAFE", is integrated within the slit pattern 5. In this embodiment, the individual slits extend through the characters of the latent image 24, but the slit pattern configuration within these characters are less densely packed than the slit pattern outside of the characters of latent image 24. As shown in FIG. 10, only every other slit from the slit pattern 5 is permitted to extend within the characters of the latent image 24. This ratio may be modified depending upon the particular latent image pattern and slit pattern employed, and is also dependant upon the particular application to which this invention is used for. For example, in the embodiments shown in FIGS. 11–14, none of the slits from slit pattern 5 extend within the characters of latent image 24. On the other hand, it is contemplated that some applications would require the slits within the characters of a latent image to be more densely packed than the slits outside of the characters.

Figure 11:
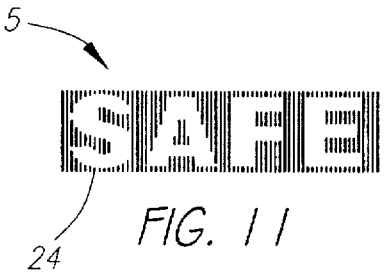
Figure 12:
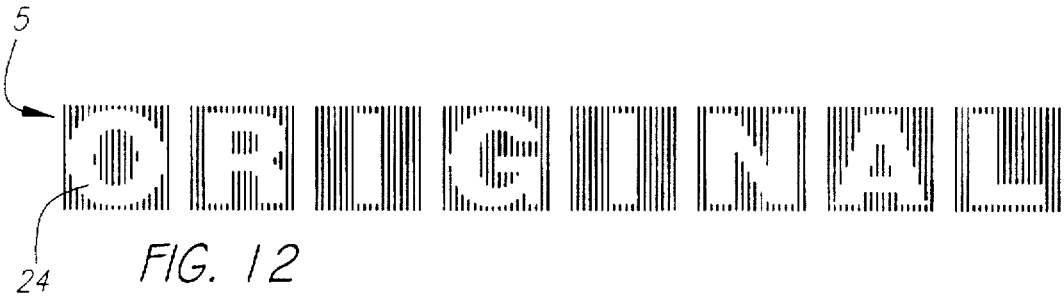
Figure 13:
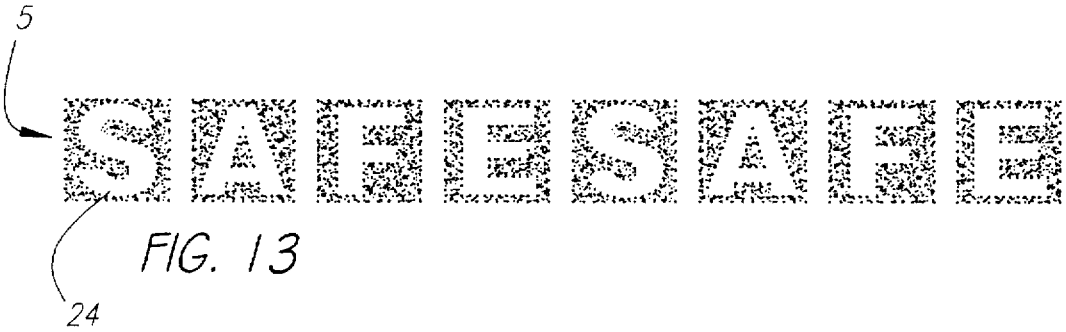
Figure 14:
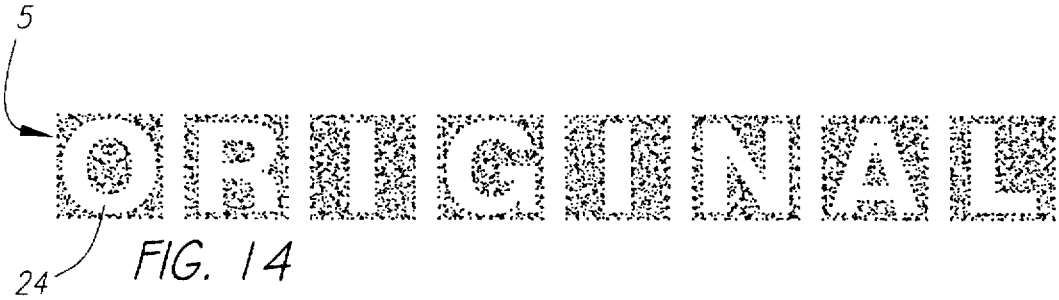

FIGS. 11 and 12 show embodiments of the present invention where the individual slits of slit pattern 5 extend in vertical and horizontal directions relative to the orientation of the text of latent image 24. FIG. 13 and 14 show embodiments where the slits of slit pattern 5 extend in directions which are 45 degrees relative to the orientation of the text of latent image 24. In general, the individual slits of slit pattern 5 may be oriented in any direction necessary to practice the invention for any particular application, and the orientation shown in these figures are not intended to be limiting in any way. In the preferred embodiment, the individual slits of slit pattern 5 are placed such that they extend at either 45 degrees or 90 degrees relative to the grain of the paper or material which forms the substrate 4.

In addition, latent image 24 may comprise a series of "blocks" of individual characters having a slit pattern 5, with a section of non-slit substrate placed between each block as shown in FIGS. 10, 12, 13, and 14. Alternatively, FIG. 11 shows a contiguous section of a slit pattern 5 with no sections of non-slit substrate placed between the individual characters of latent image 24.

Although this particular invention has been described in detail with particular reference to the preferred embodiments as illustrated and described herein, as would be obvious to those skilled in the art after a review of the drawings and specification, various modifications may be made which are encompassed by the present invention and the scope of the invention is not to be restricted except within the scope and spirit of the appended claims.

What is claimed is:

1. A tamper and counterfeit resistant document comprising:

a substrate comprising a top and bottom surface;

a tamper-resistant validation mark, said tamper-resistant validation mark comprising an area for the application of toner or ink, said tamper-resistant validation mark comprising a slit pattern;

said slit pattern comprising a first plurality of slits having a first axis and a second plurality of slits having a second axis, wherein said first axis and said second axis intersect; and said substrate having reduced tensile strength between adjacent slits in a direction perpendicular to said first axis and in a direction perpendicular to said second axis, whereby the tamper and counterfeit resistant capability of said document is enhanced.

2. The tamper and counterfeit resistant document of claim 1 wherein each of said plurality of slits comprises an inner wall and a subsurface area, said inner wall and said subsurface area of said substrate permeable to said toner or ink.

3. The tamper and counterfeit resistant document of claim 2 wherein said toner or ink said bottom surface of said substrate permeable to said toner or ink.

4. The tamper and counterfeit resistant document of claim 1 wherein said slit pattern comprises a pattern of non-intersecting slits.

5. The tamper and counterfeit resistant document of claim 1 wherein said slit pattern comprises a pattern of intersecting slits.

6. The tamper and counterfeit resistant document of claim 1 wherein each of said plurality of slits partially extends from said top surface of said substrate to said bottom surface of said substrate, said slits of said plurality of slits being relative short, whereby the structural integrity of said substrate is maintained.

7. The tamper and counterfeit resistant document of claim 1 wherein each of said plurality of slits partially extends from said top surface of said substrate to said bottom surface of said substrate.

8. The tamper and counterfeit resistance document of claim 1 wherein said tamper-resistant validation mark comprises a first and a second relief structure, said first relief structure forming a background relief pattern, said first relief pattern defined by said slit pattern, said second relief structure forming an intelligible image relief pattern, said second relief structure having a relief different than that of said first relief structure, said background relief pattern and said intelligible exposed to electromagnetic radiation, whereby said intelligible image relief pattern is complementary to said background relief pattern.

9. The tamper and counterfeit resistant document of claim 8 wherein said electromagnetic radiation comprises rays of light.

10. The tamper and counterfeit resistant document of claim 1 wherein said tamper-resistant validation mark comprises a camouflage background pattern printed on at least a portion of said top surface of said substrate, a latent image overprinted on said camouflage background, said latent image and said camouflage background pattern having contrasting optical properties when exposed to electromagnetic radiation.

11. The tamper and counterfeit resistant document of claim 10 wherein said camouflage background pattern comprises an asymmetrical pattern of alternating dark-and-light areas.

* * * * *